US008322796B2

(12) United States Patent
Hall et al.

(10) Patent No.: US 8,322,796 B2
(45) Date of Patent: Dec. 4, 2012

(54) SEAL WITH CONTACT ELEMENT FOR PICK SHIELD

(75) Inventors: David R. Hall, Provo, UT (US); Ronald B. Crockett, Provo, UT (US); Gary Peterson, Salem, UT (US); Jeffrey B. Jepson, Spanish Fork, UT (US)

(73) Assignee: Schlumberger Technology Corporation, Houston, TX (US)

( * ) Notice: Subject to any disclaimer, the term of this patent is extended or adjusted under 35 U.S.C. 154(b) by 318 days.

(21) Appl. No.: 12/424,815

(22) Filed: Apr. 16, 2009

(65) Prior Publication Data

US 2010/0264721 A1 Oct. 21, 2010

(51) Int. Cl.
*E21C 35/197* (2006.01)

(52) U.S. Cl. ..... 299/106; 299/110

(58) Field of Classification Search ..... 299/79.1, 299/80.1, 106, 107, 110; 277/404–406; *E21C 35/197, 35/193, 35/18, 35/19*
See application file for complete search history.

(56) References Cited

U.S. PATENT DOCUMENTS

| | | | |
|---|---|---|---|
| 465,103 | A | 12/1891 | Wegner |
| 616,118 | A | 12/1898 | Kuhne |
| 946,060 | A | 1/1910 | Looker |
| 1,116,154 | A | 11/1914 | Stowers |
| 1,183,630 | A | 5/1916 | Bryson |
| 1,189,560 | A | 7/1916 | Gondos |
| 1,360,908 | A | 11/1920 | Everson |
| 1,387,733 | A | 8/1921 | Midgett |
| 1,460,671 | A | 7/1923 | Hebsacker |
| 1,544,757 | A | 7/1925 | Hufford et al. |
| 1,821,474 | A | 9/1931 | Mercer |
| 1,879,177 | A | 9/1932 | Gault |
| 2,004,315 | A | 6/1935 | Fean |
| 2,054,255 | A | 9/1936 | Howard |
| 2,064,255 | A | 12/1936 | Garfield |
| 2,124,438 | A | 7/1938 | Struk et al. |
| 2,169,223 | A | 8/1939 | Christian |
| 2,218,130 | A | 10/1940 | Court |
| 2,255,650 | A | 9/1941 | Burker |
| 2,320,136 | A | 5/1943 | Kammerer |
| 2,466,991 | A | 4/1949 | Kammerer |
| 2,540,464 | A | 2/1951 | Stokes |
| 2,544,036 | A | 3/1951 | McCann |
| 2,720,392 | A | 2/1955 | Cartlidge |
| 2,755,071 | A | 7/1956 | Kammerer, Jr. |
| 2,776,819 | A | 1/1957 | Brown |
| 2,819,043 | A | 1/1958 | Henderson |
| 2,838,284 | A | 6/1958 | Austin |
| 2,894,722 | A | 7/1959 | Buttolph |
| 2,901,223 | A | 8/1959 | Scott |

(Continued)

FOREIGN PATENT DOCUMENTS

| | | |
|---|---|---|
| DE | 3307910 | 9/1984 |

(Continued)

*Primary Examiner* — John Kreck
(74) *Attorney, Agent, or Firm* — Brinks Hofer Gilson & Lione

(57) ABSTRACT

In one aspect of the present invention, a degradation assembly comprises a pressing seal element and a pressurized rigid element disposed intermediate a rotating component and a stationary component. The rotating component comprising an impact tip bonded to an end opposing the stationary component. The seal element may energize the rigid element against one of the components to form a slidable seal capable of holding lubricant within the assembly and keeping debris out while still rotating.

19 Claims, 7 Drawing Sheets

U.S. PATENT DOCUMENTS

| | | | |
|---|---|---|---|
| 2,963,102 | A | 12/1960 | Smith |
| 2,989,295 | A | 6/1961 | Prox, Jr. |
| 3,135,341 | A | 6/1964 | Ritter |
| 3,254,392 | A | 6/1966 | Novkov |
| 3,294,186 | A | 12/1966 | Buell |
| 3,301,339 | A | 1/1967 | Pennebaker, Jr. |
| 3,336,081 | A | 8/1967 | Griffin |
| 3,342,531 | A | 9/1967 | Krekeler |
| 3,342,532 | A | 9/1967 | Krekeler |
| 3,379,264 | A | 4/1968 | Cox |
| 3,397,012 | A | 8/1968 | Krekeler |
| 3,397,013 | A | 8/1968 | Krekeler |
| 3,429,390 | A | 2/1969 | Bennett |
| 3,429,617 | A | 2/1969 | Lauber |
| 3,468,553 | A | 9/1969 | Ashby et al. |
| 3,493,165 | A | 2/1970 | Schonfeld |
| 3,498,677 | A | 3/1970 | Morrow |
| 3,512,838 | A | 5/1970 | Kniff |
| 3,583,504 | A | 6/1971 | Aalund |
| 3,627,381 | A | 12/1971 | Krekeler |
| 3,650,565 | A | 3/1972 | Kniff |
| 3,655,244 | A | 4/1972 | Swisher |
| 3,746,396 | A | 7/1973 | Radd |
| 3,751,115 | A | 8/1973 | Proctor |
| 3,764,493 | A | 10/1973 | Rosar et al. |
| 3,767,266 | A | 10/1973 | Krekeler |
| 3,778,112 | A | 12/1973 | Krekeler |
| 3,801,158 | A | 4/1974 | Radd et al. |
| 3,807,804 | A | 4/1974 | Kniff |
| 3,830,321 | A | 8/1974 | McKenry |
| 3,833,265 | A | 9/1974 | Elders |
| 3,865,437 | A | 2/1975 | Crosby |
| 3,932,952 | A | 1/1976 | Helton et al. |
| 3,942,838 | A | 3/1976 | Bailey et al. |
| 3,945,681 | A | 3/1976 | White |
| 3,957,307 | A | 5/1976 | Varda |
| 3,960,223 | A | 6/1976 | Kleine |
| 4,005,914 | A | 2/1977 | Newman |
| 4,006,936 | A | 2/1977 | Crabiel |
| 4,081,042 | A | 3/1978 | Johnson et al. |
| 4,084,856 | A | 4/1978 | Emmerich et al. |
| 4,098,362 | A | 7/1978 | Bonnice |
| 4,106,577 | A | 8/1978 | Summers |
| 4,109,737 | A | 8/1978 | Bovenkerk |
| 4,149,753 | A | 4/1979 | Stoltz |
| 4,156,329 | A | 5/1979 | Daniels et al. |
| 4,199,035 | A | 4/1980 | Thompson |
| 4,201,421 | A | 5/1980 | Den Besten |
| 4,247,150 | A | 1/1981 | Wrulich et al. |
| 4,251,109 | A | 2/1981 | Roepke |
| 4,268,089 | A | 5/1981 | Spence et al. |
| 4,277,106 | A | 7/1981 | Sahley |
| 4,307,786 | A | 12/1981 | Evans |
| 4,337,980 | A | 7/1982 | Krekeler |
| 4,397,362 | A | 8/1983 | Dice et al. |
| 4,416,339 | A | 11/1983 | Baker et al. |
| 4,439,250 | A | 3/1984 | Acharya et al. |
| 4,448,269 | A | 5/1984 | Ishikawa et al. |
| 4,453,775 | A | 6/1984 | Clemmow |
| 4,465,221 | A | 8/1984 | Schmidt |
| 4,484,644 | A | 11/1984 | Cook |
| 4,484,783 | A | 11/1984 | Emmerich |
| 4,485,221 | A | 11/1984 | Krueger et al. |
| 4,489,986 | A | 12/1984 | Dziak |
| 4,497,520 | A | 2/1985 | Ojanen |
| 4,531,592 | A | 7/1985 | Hayatdavoudi |
| 4,537,448 | A | 8/1985 | Ketterer |
| 4,542,942 | A | 9/1985 | Zitz et al. |
| 4,566,545 | A | 1/1986 | Story et al. |
| 4,579,491 | A | 4/1986 | Kull |
| 4,583,786 | A | 4/1986 | Thorpe et al. |
| 4,627,665 | A | 12/1986 | Ewing et al. |
| 4,647,111 | A | 3/1987 | Browder et al. |
| 4,660,890 | A | 4/1987 | Mills |
| 4,669,786 | A | 6/1987 | Morgan et al. |
| 4,678,237 | A | 7/1987 | Collin |
| 4,682,987 | A | 7/1987 | Brady |
| 4,688,856 | A | 8/1987 | Elfgen |
| 4,694,918 | A | 9/1987 | Hall |
| 4,702,525 | A | 10/1987 | Sollami et al. |
| 4,725,098 | A | 2/1988 | Beach |
| 4,728,153 | A | 3/1988 | Ojanen et al. |
| 4,729,603 | A | 3/1988 | Elfgen |
| 4,736,533 | A | 4/1988 | May et al. |
| 4,746,379 | A | 5/1988 | Rabinkin |
| 4,765,686 | A | 8/1988 | Adams |
| 4,765,687 | A | 8/1988 | Parrott |
| 4,776,862 | A | 10/1988 | Wiand |
| 4,804,231 | A | 2/1989 | Buljan et al. |
| 4,811,801 | A | 3/1989 | Salesky et al. |
| 4,836,614 | A | 6/1989 | Ojanen et al. |
| 4,850,649 | A | 7/1989 | Beach et al. |
| 4,880,154 | A | 11/1989 | Tank |
| 4,893,875 | A | 1/1990 | Lonn et al. |
| 4,907,665 | A | 3/1990 | Kar et al. |
| 4,911,503 | A | 3/1990 | Stiffler |
| 4,911,504 | A | 3/1990 | Stiffler |
| 4,921,310 | A | 5/1990 | Hedlund et al. |
| 4,932,723 | A | 6/1990 | Mills |
| 4,940,288 | A | 7/1990 | Stiffler |
| 4,941,711 | A | 7/1990 | Stiffler |
| 4,944,559 | A | 7/1990 | Sionnet |
| 4,951,762 | A | 8/1990 | Lundell |
| 4,956,238 | A | 9/1990 | Griffin |
| 4,962,822 | A | 10/1990 | Pascale |
| 4,981,328 | A | 1/1991 | Stiffler |
| 5,007,685 | A | 4/1991 | Beach et al. |
| 5,009,273 | A | 4/1991 | Grabinski |
| 5,011,515 | A | 4/1991 | Frushour |
| 5,018,793 | A | 5/1991 | Den Besten |
| 5,038,873 | A | 8/1991 | Jurgens |
| 5,088,797 | A | 2/1992 | O'Neill |
| 5,106,166 | A | 4/1992 | O'Neill |
| 5,112,165 | A | 5/1992 | Hedlund |
| 5,119,714 | A | 6/1992 | Scott et al. |
| 5,141,063 | A | 8/1992 | Quesenbury |
| 5,141,289 | A | 8/1992 | Stiffler |
| 5,154,245 | A | 10/1992 | Waldenstrom |
| 5,186,892 | A | 2/1993 | Pope |
| 5,251,964 | A | 10/1993 | Ojanen |
| 5,261,499 | A | 11/1993 | Grubb |
| D342,268 | S | 12/1993 | Meyer |
| 5,303,984 | A | 4/1994 | Ojanen |
| 5,332,051 | A | 7/1994 | Knowlton |
| 5,332,348 | A | 7/1994 | Lemelson |
| 5,361,859 | A | 11/1994 | Tibbitts |
| 5,374,111 | A | 12/1994 | Den Besten et al. |
| 5,415,462 | A | 5/1995 | Massa |
| 5,417,292 | A | 5/1995 | Polakoff |
| 5,417,475 | A | 5/1995 | Graham |
| 5,447,208 | A | 9/1995 | Lund |
| 5,503,463 | A | 4/1996 | Ojanen |
| 5,507,357 | A | 4/1996 | Hult et al. |
| 5,535,839 | A | 7/1996 | Brady |
| 5,542,993 | A | 8/1996 | Rabinkin |
| 5,560,440 | A | 10/1996 | Tibbitts |
| 5,568,838 | A | 10/1996 | Struthers et al. |
| 5,611,654 | A | 3/1997 | Frattarola et al. |
| 5,653,300 | A | 8/1997 | Lund |
| 5,662,720 | A | 9/1997 | O'Tigheamaigh |
| 5,678,644 | A | 10/1997 | Fielder |
| 5,720,528 | A | 2/1998 | Ritchey |
| 5,725,283 | A | 3/1998 | O'Neill |
| 5,730,502 | A | 3/1998 | Montgomery, Jr. |
| 5,732,784 | A | 3/1998 | Nelson |
| 5,736,698 | A | 4/1998 | Kapoor |
| 5,823,632 | A | 10/1998 | Burkett |
| 5,837,071 | A | 11/1998 | Andersson et al. |
| 5,842,747 | A | 12/1998 | Winchester |
| 5,845,547 | A | 12/1998 | Sollami |
| 5,848,657 | A | 12/1998 | Flood et al. |
| 5,875,862 | A | 3/1999 | Jurewicz |
| 5,884,979 | A | 3/1999 | Latham |
| 5,890,552 | A | 4/1999 | Scott et al. |
| 5,896,938 | A | 4/1999 | Moeny et al. |
| 5,934,542 | A | 8/1999 | Nakamura |
| 5,935,718 | A | 8/1999 | Demo |

| | | | |
|---|---|---|---|
| 5,944,129 | A | 8/1999 | Jensen |
| 5,967,250 | A | 10/1999 | Lund |
| 5,992,405 | A | 11/1999 | Sollami |
| 6,000,483 | A | 12/1999 | Jurewicz et al. |
| 6,006,846 | A | 12/1999 | Tibbitts |
| 6,019,434 | A | 2/2000 | Emmerich |
| 6,044,920 | A | 4/2000 | Massa |
| 6,051,079 | A | 4/2000 | Andersson |
| 6,056,911 | A | 5/2000 | Griffin |
| 6,059,373 | A | 5/2000 | Wright et al. |
| 6,065,552 | A | 5/2000 | Scott |
| 6,099,081 | A | 8/2000 | Warren et al. |
| 6,102,486 | A | 8/2000 | Briese |
| 6,113,195 | A | 9/2000 | Mercier |
| 6,170,917 | B1 | 1/2001 | Heinrich |
| 6,193,770 | B1 | 2/2001 | Sung |
| 6,196,636 | B1 | 3/2001 | Mills |
| 6,196,910 | B1 | 3/2001 | Johnson |
| 6,199,645 | B1 | 3/2001 | Anderson et al. |
| 6,199,956 | B1 | 3/2001 | Kammerer |
| 6,202,761 | B1 | 3/2001 | Forney |
| 6,216,805 | B1 | 4/2001 | Lays |
| 6,270,165 | B1 | 8/2001 | Peay |
| 6,331,035 | B1 | 12/2001 | Montgomery, Jr. |
| 6,332,503 | B1 | 12/2001 | Pessier et al. |
| 6,341,823 | B1 | 1/2002 | Sollami |
| 6,354,771 | B1 | 3/2002 | Bauschulte |
| 6,357,832 | B1 | 3/2002 | Sollami |
| 6,364,420 | B1 | 4/2002 | Sollami |
| 6,371,567 | B1 | 4/2002 | Sollami |
| 6,375,272 | B1 | 4/2002 | Ojanen |
| 6,397,652 | B1 | 6/2002 | Sollami |
| 6,408,959 | B2 | 6/2002 | Bertagnolli et al. |
| 6,412,163 | B1 | 7/2002 | Russell |
| 6,419,278 | B1 | 7/2002 | Cunningham |
| 6,439,326 | B1 | 8/2002 | Huang et al. |
| 6,460,637 | B1 | 10/2002 | Siracki et al. |
| 6,478,383 | B1 | 11/2002 | Ojanen |
| 6,481,803 | B2 | 11/2002 | Ritchey |
| 6,484,826 | B1 | 11/2002 | Anderson et al. |
| 6,499,547 | B2 | 12/2002 | Scott |
| 6,508,516 | B1 | 1/2003 | Kammerer |
| 6,517,902 | B2 | 2/2003 | Drake |
| 6,533,050 | B2 | 3/2003 | Molloy |
| 6,585,326 | B2 | 7/2003 | Sollami |
| 6,601,454 | B1 | 8/2003 | Botnan |
| 6,601,662 | B2 | 8/2003 | Matthias et al. |
| 6,644,755 | B1 | 11/2003 | Kammerer |
| 6,651,758 | B2 | 11/2003 | Xiang et al. |
| 6,668,949 | B1 | 12/2003 | Rives |
| 6,672,406 | B2 | 1/2004 | Beuershausen |
| 6,685,273 | B1 | 2/2004 | Sollami |
| 6,692,083 | B2 | 2/2004 | Latham |
| 6,702,393 | B2 | 3/2004 | Mercier |
| 6,709,065 | B2 | 3/2004 | Peay |
| 6,719,074 | B2 | 4/2004 | Tsuda |
| 6,732,817 | B2 | 5/2004 | Dewey et al. |
| 6,732,914 | B2 | 5/2004 | Sollami |
| 6,733,087 | B2 | 5/2004 | Hall |
| 6,739,327 | B2 | 5/2004 | Sollami |
| 6,758,530 | B2 | 7/2004 | Sollami |
| 6,786,557 | B2 | 9/2004 | Montgomery, Jr. |
| 6,824,225 | B2 | 11/2004 | Stiffler |
| 6,846,045 | B2 | 1/2005 | Sollami |
| 6,851,758 | B2 | 2/2005 | Beach |
| 6,854,810 | B2 | 2/2005 | Montgomery, Jr. |
| 6,861,137 | B2 | 3/2005 | Griffin et al. |
| 6,863,352 | B2 | 3/2005 | Sollami |
| 6,889,890 | B2 | 5/2005 | Yamazaki et al. |
| 6,929,076 | B2 | 8/2005 | Fanuel et al. |
| 6,938,961 | B2 | 9/2005 | Broom |
| 6,953,096 | B2 | 10/2005 | Gledhill et al. |
| 6,962,395 | B2 | 11/2005 | Mouthaan |
| 6,966,611 | B1 | 11/2005 | Sollami |
| 6,994,404 | B1 | 2/2006 | Sollami |
| 7,118,181 | B2 | 10/2006 | Frear |
| 7,204,560 | B2 | 4/2007 | Mercier |
| 7,234,782 | B2 | 6/2007 | Stehney |
| D560,699 | S | 1/2008 | Omi |
| 7,343,947 | B1 | 3/2008 | Sollami |
| 7,369,743 | B2 | 5/2008 | Watkins et al. |
| 7,387,345 | B2 | 6/2008 | Hall et al. |
| 7,390,066 | B2 | 6/2008 | Hall et al. |
| 7,413,256 | B2 | 8/2008 | Hall et al. |
| 7,413,258 | B2 | 8/2008 | Hall et al. |
| 7,419,224 | B2 * | 9/2008 | Hall et al. ..... 299/107 |
| 7,669,938 | B2 | 3/2010 | Hall et al. |
| 7,992,944 | B2 | 8/2011 | Hall et al. |
| 2001/0004946 | A1 | 6/2001 | Jensen |
| 2002/0070602 | A1 | 6/2002 | Sollami |
| 2002/0074851 | A1 | 6/2002 | Montgomery |
| 2002/0153175 | A1 | 10/2002 | Ojanen |
| 2002/0175555 | A1 | 11/2002 | Mercier |
| 2003/0015907 | A1 | 1/2003 | Sollami |
| 2003/0047985 | A1 | 3/2003 | Stiffler |
| 2003/0052530 | A1 | 3/2003 | Sollami |
| 2003/0110667 | A1 | 6/2003 | Adachi |
| 2003/0137185 | A1 | 7/2003 | Sollami |
| 2003/0140360 | A1 | 7/2003 | Mansuy et al. |
| 2003/0141350 | A1 | 7/2003 | Noro |
| 2003/0141753 | A1 | 7/2003 | Peay et al. |
| 2003/0209366 | A1 | 11/2003 | McAlvain |
| 2003/0213354 | A1 | 11/2003 | Frers |
| 2003/0230926 | A1 | 12/2003 | Mondy et al. |
| 2003/0234280 | A1 | 12/2003 | Cadden |
| 2004/0026132 | A1 | 2/2004 | Hall et al. |
| 2004/0026983 | A1 | 2/2004 | McAlvain |
| 2004/0065484 | A1 | 4/2004 | McAlvain |
| 2005/0035649 | A1 | 2/2005 | Mercier |
| 2005/0044987 | A1 | 3/2005 | Takayama et al. |
| 2005/0159840 | A1 | 7/2005 | Lin |
| 2005/0173966 | A1 | 8/2005 | Mouthaan |
| 2006/0006727 | A1 | 1/2006 | Frear |
| 2006/0086537 | A1 | 4/2006 | Dennis |
| 2006/0086540 | A1 | 4/2006 | Griffin |
| 2006/0125306 | A1 | 6/2006 | Sollami |
| 2006/0162969 | A1 | 7/2006 | Belnap et al. |
| 2006/0186724 | A1 | 8/2006 | Stehney |
| 2006/0237236 | A1 | 10/2006 | Sreshta |
| 2006/0261663 | A1 | 11/2006 | Sollami |
| 2007/0013224 | A1 | 1/2007 | Stehney |
| 2008/0036269 | A1 * | 2/2008 | Hall et al. ..... 299/29 |
| 2008/0309146 | A1 | 12/2008 | Hall |

FOREIGN PATENT DOCUMENTS

| | | |
|---|---|---|
| DE | 3431495 | 3/1986 |
| DE | 3500261 | 7/1986 |
| DE | 3818213 | 11/1989 |
| DE | 4039217 | 6/1992 |
| DE | 19821147 | 11/1999 |
| DE | 10163717 | 5/2003 |
| EP | 0295151 | 6/1988 |
| EP | 0412287 | 7/1990 |
| EP | 0899051 | 3/1999 |
| EP | 1574309 | 9/2005 |
| GB | 2004315 | 3/1979 |
| GB | 2037223 | 11/1979 |
| GB | 2423319 | 8/2006 |
| JP | 5280273 | 10/1993 |
| JP | 3123193 | 1/2001 |
| RU | 2079651 | 5/1997 |

* cited by examiner

SEAL WITH CONTACT ELEMENT FOR PICK SHIELD

BACKGROUND

Formation degradation, such as pavement milling, mining, drilling and/or excavating, may be performed using degradation assemblies. In normal use, these assemb lies and auxiliary equipment are subjected to high impact, heat, abrasion, and other environmental factors that wear their mechanical components. Many efforts have been made to improve the service life of these assemblies, including efforts to optimize the method of attachment to the driving mechanism.

One such method is disclosed in U.S. Pat. No. 5,261,499 to Grubb, which is herein incorporated by reference for all that it contains. Grubb discloses a two-piece rotatable cutting bit which comprises a shank and a nose. The shank has an axially forwardly projecting protrusion which carries a resilient spring clip. The protrusion and spring clip are received within a recess in the nose to rotatably attach the nose to the shank.

Another such method is disclosed in U.S. Patent Publication No. 2008/0309146 to Hall, et al., which is herein incorporated by reference for all that it discloses. It discloses, in one aspect, a degradation assembly comprising a shank with a forward end and a rearward end, the rearward end being adapted for attachment to a driving mechanism, with a shield rotatably attached to the forward end of the shank. The shield comprises an underside adapted for rotatable attachment to the shank and an impact tip disposed on an end opposing the underside. A seal is disposed intermediate the shield and the shank.

BRIEF SUMMARY

In one aspect of the present invention, a degradation assembly comprises a pressing seal element and a pressurized rigid element disposed intermediate a rotating component and a stationary component. The stationary component may be attached to a driving mechanism through a block. The rotating component may comprise an impact tip bonded to an end opposing the stationary component. The seal element may energize the rigid element against one of the components to form a slidable seal capable of holding lubricant within the assembly and keeping debris out while still rotating.

The rotating element may comprise a shield with a recess opposite the impact element. The recess of the shield may rotatably connect to the first end of a shank. A second end may be retained in a holder attached to a driving mechanism. In another embodiment, the shield and the shank may comprise a single component and rotate with respect to the holder. A pressing seal element may be disposed intermediate the rotating component and the stationary component, and a pressurized rigid element may be disposed adjacent to the seal element.

The rigid element may comprise a concave and/or textured surface facing the seal element and a flat, convex, polished, and/or wear resistant surface opposing the seal element.

The seal element may comprise an O-ring, a rubber washer, or a compression spring. The seal element may comprise a textured outer surface. The assembly may comprise a wiper or a ring disposed axially around the assembly, adjacent to both the shield and the shank. The assembly may comprise a lubricant chamber. The assembly may comprise a spring clip. The shank may comprise a ledge. The assembly may comprise a pick.

DETAILED DESCRIPTION

Figure 1:
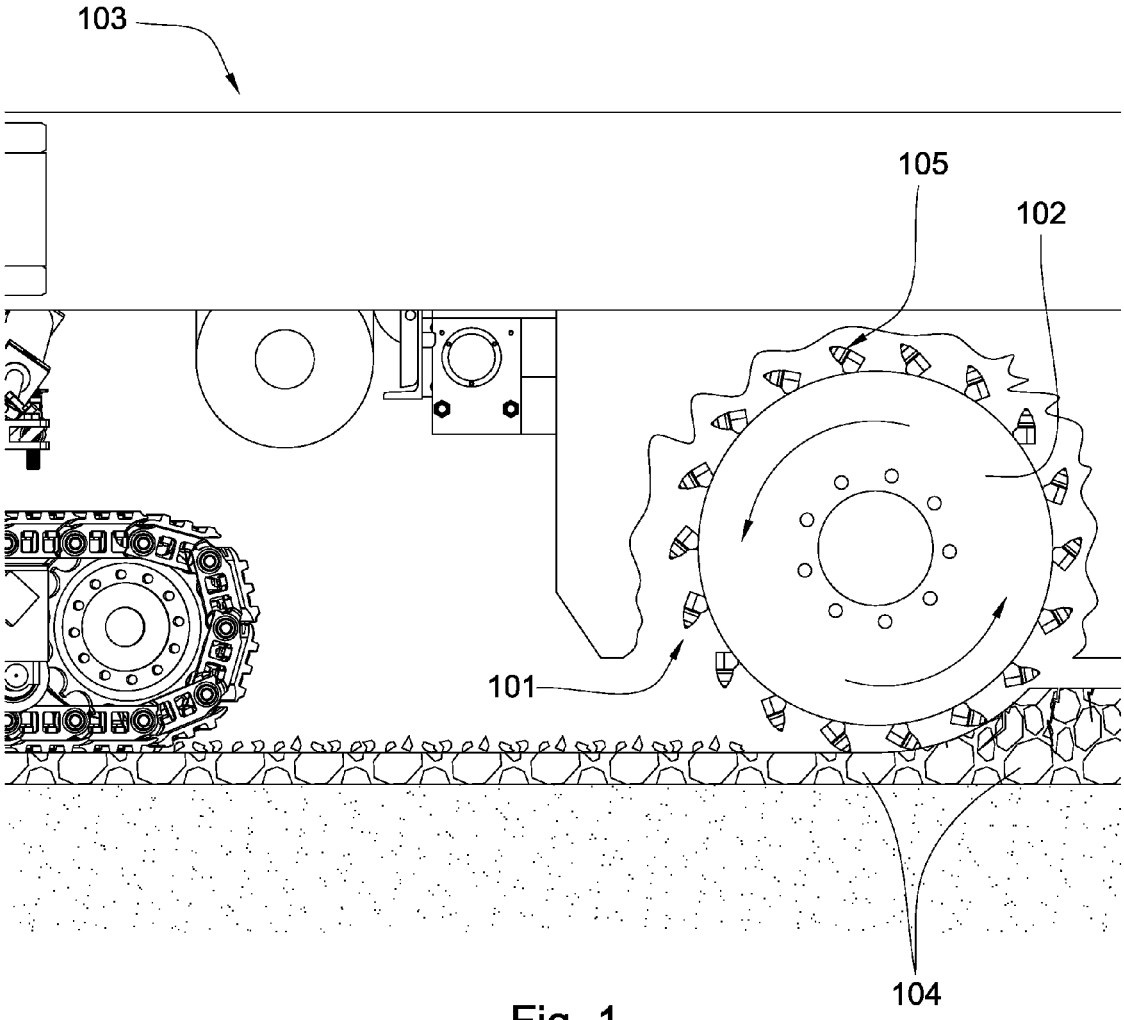
FIG. 1 is a cross-sectional diagram of an embodiment of a pavement milling machine.

FIG. 1 is a cross-sectional diagram of a pavement milling machine 103 that shows a plurality of pick degradation assemblies 101 attached to a driving mechanism 102, such as a rotatable drum, attached to the underside of the pavement milling machine 103. The pavement milling machine 103 may be an asphalt planer used to degrade man-made formations 104 such as pavement, asphalt, concrete, tarmac, blacktop or other manmade formations known in the art prior to placement of a new layer of the formation 104. The formation 104 may also comprise naturally occurring material such as stone, dirt, minerals, rubble, debris or the like. The pick degradation assemblies 101 may be attached to the rotatable drum, bringing the pick degradation assemblies 101 into engagement with the formation 104. A holder 105, such as a block or other type holder, is attached to the driving mechanism 102 by means of a weld, bolt(s) or other sturdy fastening means known in the art. The pick degradation assembly 101 may be inserted into the holder 105. The holder 105 may hold the pick degradation assembly 101 at an angle offset from the direction of rotation, such that the pick degradation assembly engages the formation 104 at a preferential angle. While an embodiment of a pavement milling machine 103 was used in the above example, it should be understood that pick degradation assemblies 101 disclosed herein have a variety of uses and implementations that may not be specifically discussed within this disclosure.

It is believed that while in use, a nonrotatable pick degradation assembly 101 may receive uneven wear on a single side because the same side is continuously engaging a formation 104. This uneven wear may shorten the life of the pick degradation assembly 101. It is further believed that the life of the assembly 101 may be lengthened by rotating the assembly such that different sides of the assembly 101 are engaging the formation 104 throughout the life of the pick degradation assembly 101.

Figure 2:
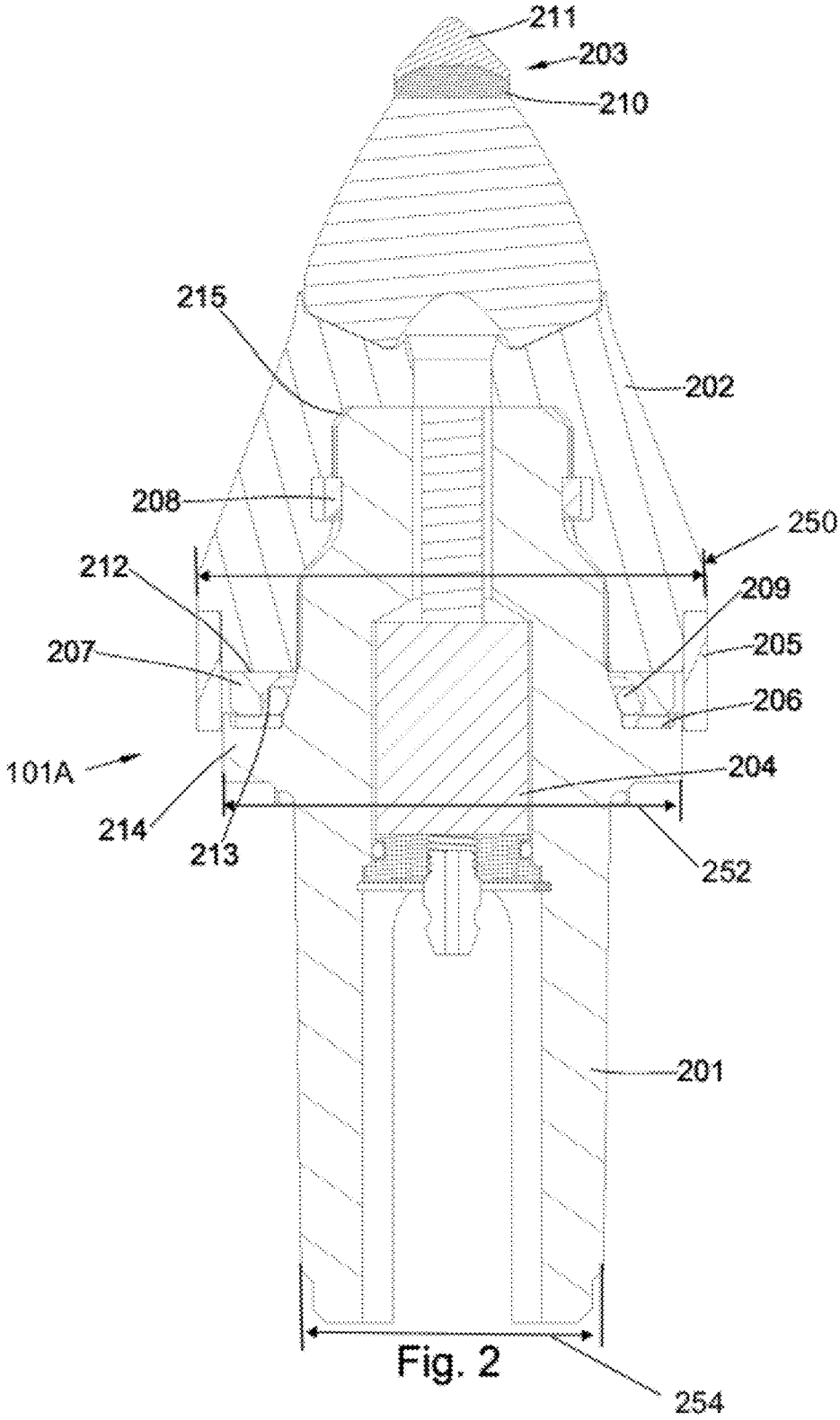
FIG. 2 is a cross-sectional diagram of an embodiment of a degradation assembly.

Referring now to FIG. 2, a cross-sectional view of an embodiment of a pick degradation assembly 101A is depicted. The pick degradation assembly 101A may comprise a shield 202A and a shank 201A. The shield 202A may comprise a recess 215A. The recess 215A may be a blind recess 215A that travels into the shield 202A without passing out the other side. The recess 215A may be rotatably connected to the shank 201A. A spring clip 208A within the recess 215A may secure the shield 202A over the shank 201A while still allowing the shield 202A to rotate relative to the shank 201A. The spring clip 208A may be compressed to allow the shield 202A to fit over the shank 201A and then spring back substantially to its original form once within a depression or other ledge within the shank 201A. The shield 202A may have an axial diameter 250 sufficient to cover the shank 201A and generally protect it from impact with a formation. The shield 202A may form a cap over the shank 201A. The side of the shield 202A opposite the recess 215A may comprise a frustum or a substantially conical geometry. The substantially conical geometry may comprise an impact tip 203A bonded to the shield 202A opposing the recess 215A.

The impact tip 203A may comprise a super hard material 211A bonded to a carbide substrate 210A. The super hard material 211A may comprise diamond, polycrystalline diamond with a binder concentration of 1 to 40 percent weight, cubic boron nitride, refractory metal bonded diamond, silicon bonded diamond, layered diamond, infiltrated diamond, thermally stable diamond, natural diamond, vapor deposited diamond, physically deposited diamond, diamond impregnated matrix, diamond impregnated carbide, monolithic diamond, polished diamond, coarse diamond, fine diamond, non-metal catalyzed diamond, cemented metal carbide, chromium, titanium, aluminum, tungsten, or combinations thereof.

The shank 201A may remain stationary with respect to a holder (not shown). The shank 201A may comprise a ledge 214A that may flare out to meet the shield 202A. The ledge 214A may have a ledge diameter 252 larger than a shank diameter 254 of the majority of the shank 201A. The shank 201A may include a lubricant chamber 204A. The pick degradation assembly may also comprise a seal 206A, 209A and a protective ring 205A. A rigid element 207A may be disposed adjacent to the seal 206A, 209A. The rigid element 207A and seal 206A, 209A may be disposed adjacent to the ledge 214A.

The shield 202A may be able to freely rotate around the shank 201A. The lubricant chamber 204A may dispense lubricant intermediate, or between, the shank 201A and the shield 202A. The lubricant may aid in the rotation of the shield 202A with respect to the shank 201A. It is believed that by allowing the shield 202A to freely rotate around the shank 201A, that the wear on the pick degradation assembly 101A during operation will on average be spread around the entire assembly as opposed to just a single side. Furthermore, it is believed that by spreading the wear around the entire assembly 101, the assembly 101 may last longer.

The seal 206A, 209A may be disposed intermediate, or between, the shank 201A and the shield 202A. The seal may comprise an O-ring 209A and a rubber washer 206A. The seal 206A, 209A may serve the purpose of sealing lubricant within the pick degradation assembly 101A and keeping dirt and debris from penetrating the space intermediate, or between the shield 202A and the shank 201A. A protective ring 205A may be disposed axially around the assembly 101A, adjacent to both the shield 202A and the shank 201A. The protective ring 205A may prevent particles from entering the vicinity of the rigid element 207A and the seal 206A, 209A. The protective ring 205A may comprise a wiper 255 (see FIG. 7*c*), a metal ring, a plastic ring, or another ring of sufficient dimensions to be disposed around the pick degradation assembly 101A while limiting access to the space intermediate, or between, the shank 201A and the shield 202A. It is believed that the seal 209A, 206A may prematurely wear and fail if it is physically exposed to the rotating surface of the pick degradation assembly 101A. A rigid element 207A disposed adjacent to the seal 209A, 206A may extend the life of the seal 209A, 206A.

The rigid element 207A may comprise a ring with a concave inner surface 213A. The rigid element 207A may comprise a metal. The rigid element 207A may be disposed between the shank 201A and the shield 202A. The concave inner surface 213A of the rigid element 207A may be disposed adjacent to the O-ring 209A such that the O-ring 209A lies within a contour of the rigid element 207A. The concave inner surface 213A may comprise a texture. The textured surface may allow the rigid element 207A to more easily engage the O-ring 209A. The O-ring 209A may also comprise a textured surface to further aid in a frictional engagement with the rigid element 207A. The rigid element 207A may also have a surface that engages the rubber washer 206A. It is believed that the friction created by the interaction between the rigid element 207A, the O-ring 209A and the rubber washer 206A may prevent the rigid element 207A from rotating with respect to the shank 201A.

The rigid element 207A may also comprise a flat surface 212A. The flat surface 212A may be polished such that it is smooth. The flat surface 212A may be adjacent to the shield 202A. The polished flat surface 212A of the rigid element 207A may provide a surface for the shield 202A to rotate upon with respect to the shank 201A. The rigid element 207A may place the O-ring 209A under compression. The elastic nature of the O-ring 209A may in turn place an opposing force on the rigid element 207A forcing it into contact with the shield 202A. As the pick degradation assembly 101A is used and the shield 202A rotates with respect to the shank 201A, the friction exerted by the shield 202A onto the polished flat surface 212A of the rigid element 207A may cause it to wear and grow thinner. It is believed that the force exerted by the O-ring 209A onto the rigid element 207A will force the rigid element 207A to remain in contact with the shield 202A even after it has become worn.

In some embodiments the rigid element 207A may comprise a wear resistant surface 212A. The wear resistant surface 212A may comprise a material such as diamond, cubic boron nitride, lonsdaleite, tungsten carbide, or a combination thereof. The wear resistant surface 212A may aid in extending the useable working life of the pick degradation assembly 101A.

Figure 3:
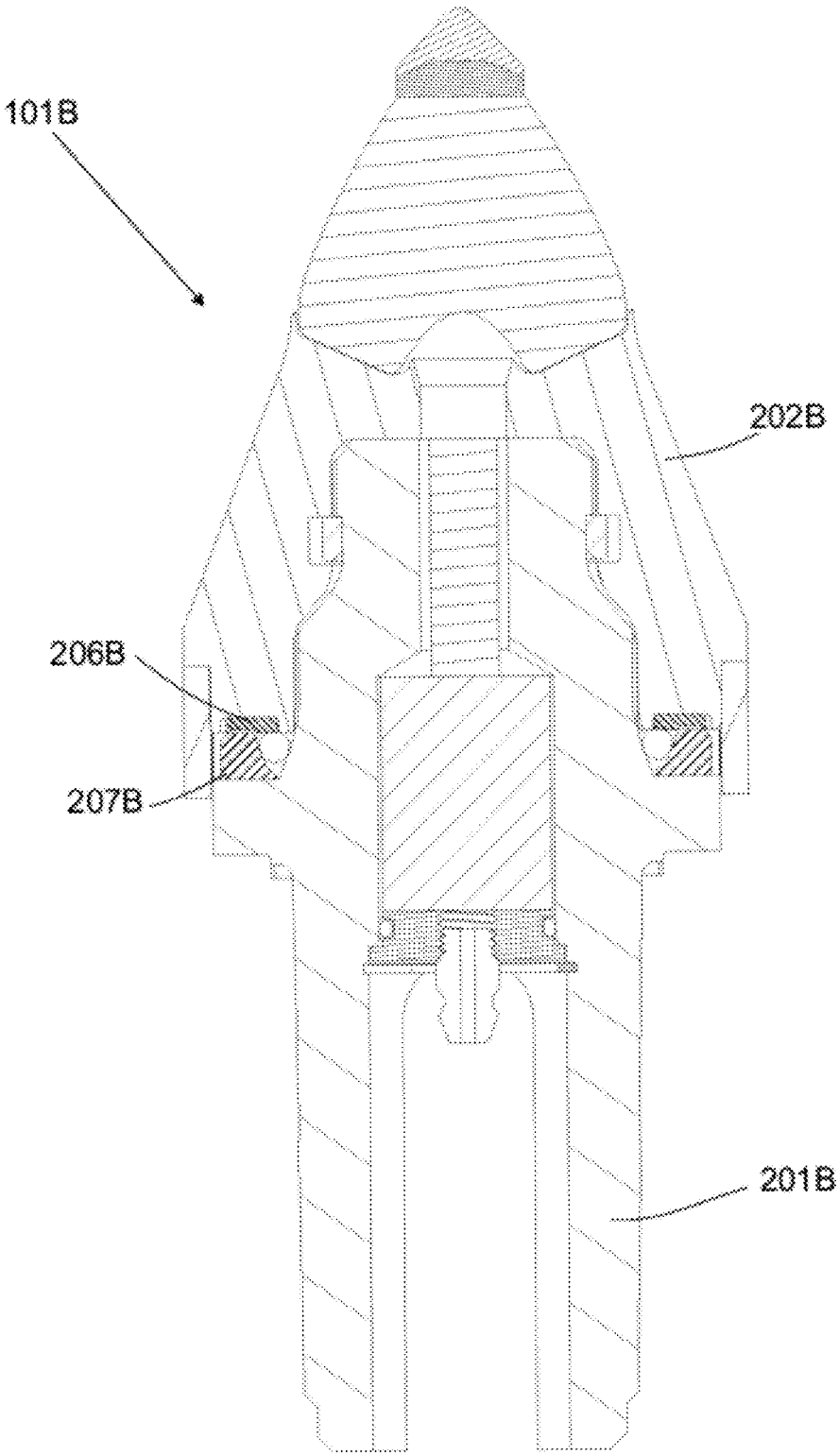
FIG. 3 is a cross-sectional diagram of another embodiment of a degradation assembly.

Now referring to the embodiment of a pick degradation assembly 101B depicted in FIG. 3, a rigid element 207B has been flipped 180 degrees with respect to the rigid element 207A in FIG. 2. A rubber washer 206B has been disposed in a shield 202B instead of in the shank 201A as in FIG. 2. In this embodiment the rigid element 207B may be frictionally engaged with the shield 202B, such that during rotation, the rigid element 207B may remain stationary with respect to the shield 202B. In this embodiment, a flat surface 212B may be adjacent to a shank 201B.

Figure 4:
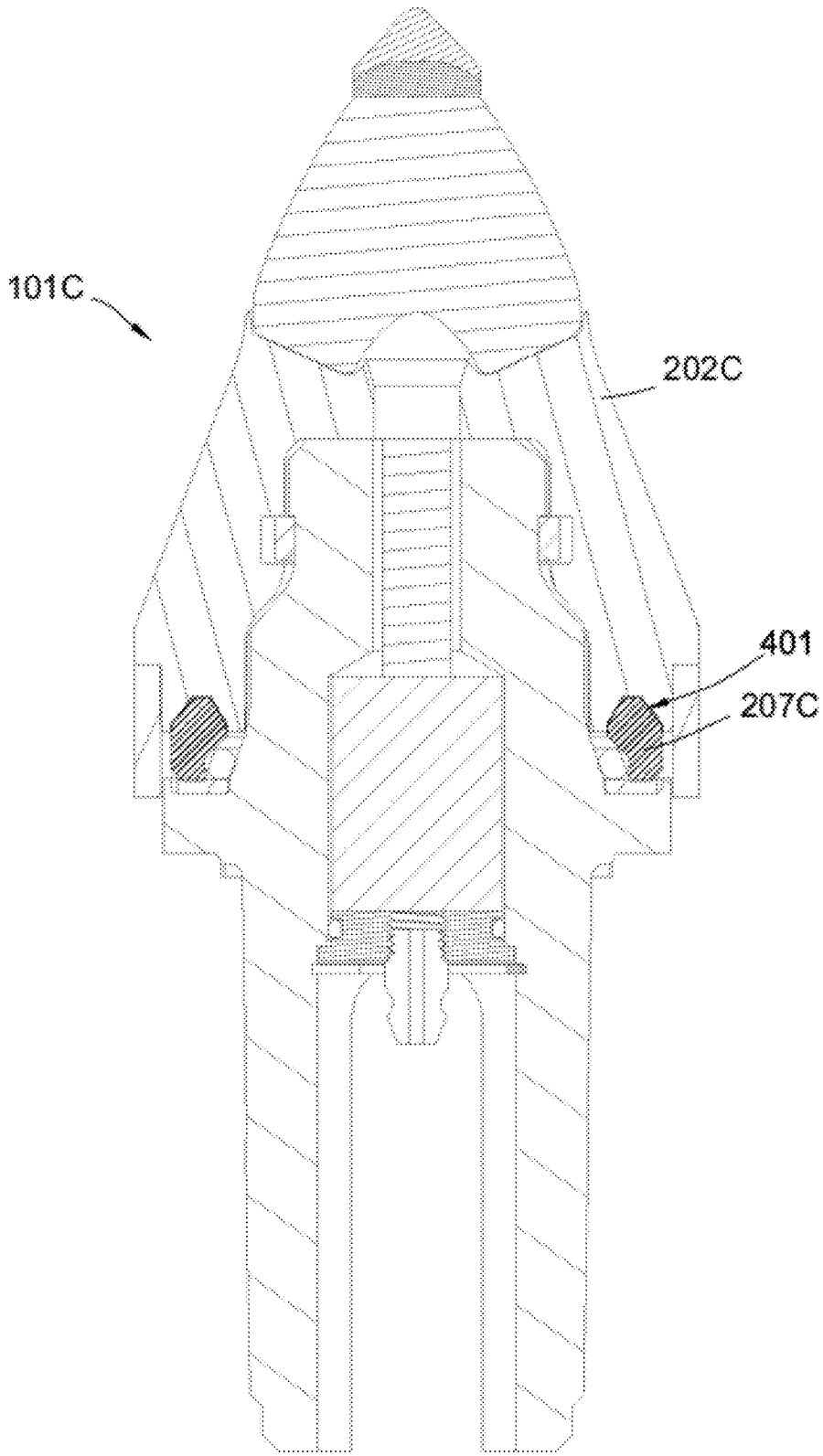
FIG. 4 is a cross-sectional diagram of another embodiment of a degradation assembly.

Referring now to FIG. 4, a rigid element 207C may comprise a convex surface 401. The convex surface 401 may extend into the shield 202C. During degradation operations the degradation pick assembly 101C may experience lateral jarring and vibrations. It is believed that the convex surface 401 may provide the shield 202C with additional lateral stability during rotation and degradation operations. This additional support may extend the life of the pick degradation assembly 101C by lowering the amount of wear that the pick degradation assembly 101C receives.

Figure 5:
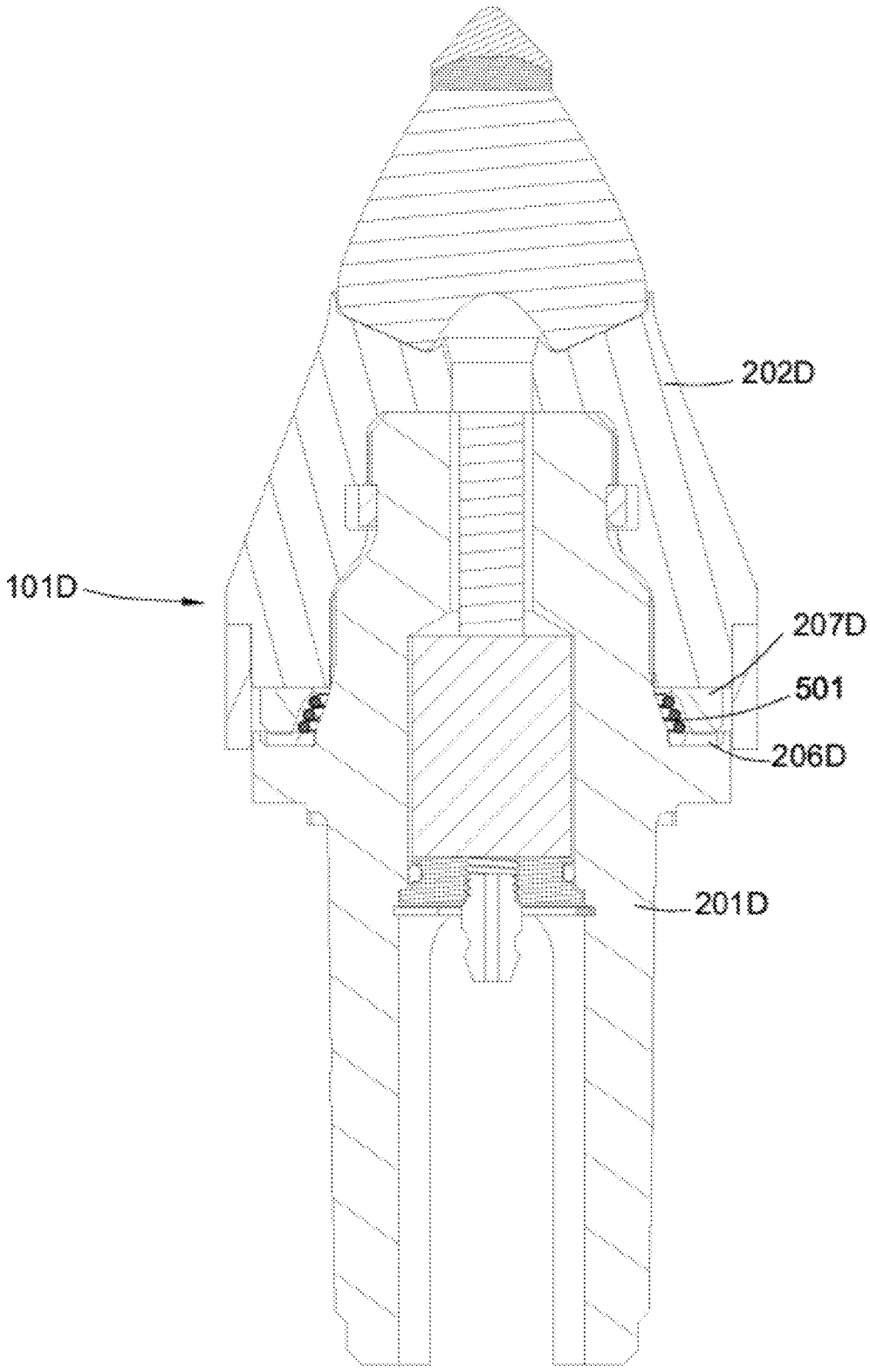
FIG. 5 is a cross-sectional diagram of another embodiment of a degradation assembly.

Referring now to FIG. 5, a pick degradation assembly 101D may comprise a spring 501. The spring 501 may be disposed intermediate, or between, a rigid element 207D and a shank 201D. The spring 501 may exert a force onto the rigid element 207D pushing the rigid element 207D into contact with a shield 202D. This may aid in maintaining contact between the rigid element 207D and the shield 202D as the rigid element 207D wears. A rubber washer 206D may function as a seal.

Figure 6:
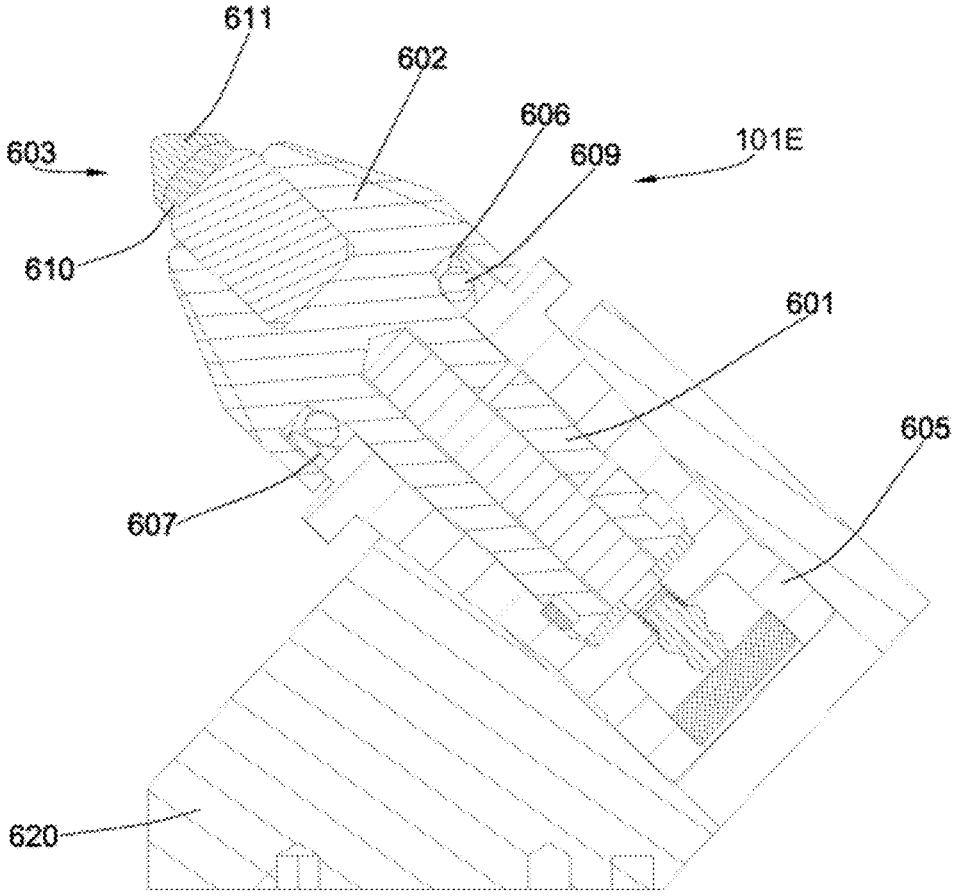
FIG. 6 is a cross-sectional diagram of an embodiment of a degradation assembly retained in a holder and further retained in a block.

Referring now to FIG. 6, a pick degradation assembly 101E may be retained in a holder 605 and further retained in a block 620. The pick degradation assembly 101E may also comprise a shield 602 and a shank 601. In this embodiment, the shield 602 may be rigidly connected to the shank 601 and rotate within the holder 605 together with the shank 601. An impact tip 603 may be bonded to the distal end of the shield 602, the impact tip comprising a superhard material 611 bonded to a carbide substrate 610. A rigid element 607 may be disposed intermediate, or between, the shield 602 and the holder 605. The rigid element 607 may be pressurized by a pressing seal element 606, 609. In this embodiment the seal element 606, 609 comprise a rubber washer 606 and an O-ring 609. The seal element 606, 609 may press the rigid element into the holder 605 as shown or alternately into the shield 602. This embodiment may allow the shield 602 and shank 601 to rotate relative to the holder 605 while maintaining lubricant within the assembly 101E.

Figure 7A:
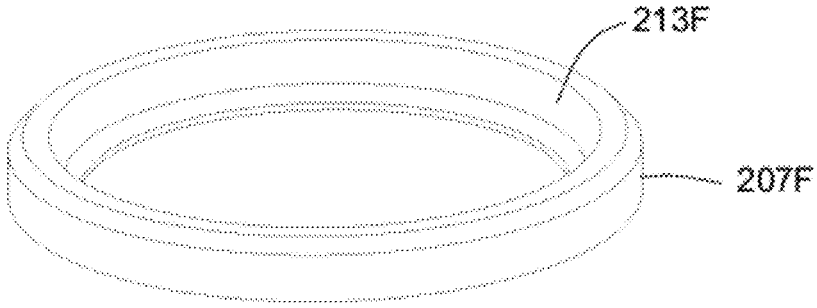
FIG. 7*a* is a perspective diagram of an embodiment of a rigid element.

FIGS. 7*a*, 7*b*, 7*c*, 7*d* and 7*e* depict embodiments of various components of a pick degradation assembly. FIG. 7*a* depicts an embodiment of a rigid element 207F. The rigid element 207F may comprise a rigid and wear resistant material such a metal. The rigid element 207F may comprise a concave inner surface 213F. The concavity of the surface 213F may change based upon the O-ring size that it is designed to receive.

Figure 7B:
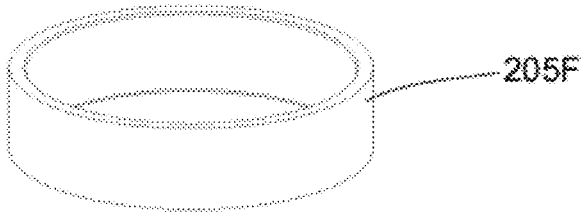
FIG. 7*b* is a perspective diagram of an embodiment of a protective ring.

FIG. 7*b* depicts an embodiment of a protective ring 205F. The protective ring 205F may comprise a rigid material such as metal or plastic. The girth of the protective ring 205F may substantially cover any gap that may exist between a shield and a shank. It is believed that the protective ring 205F may aid in preventing debris from penetrating between the shield and the shank.

Figure 7C:
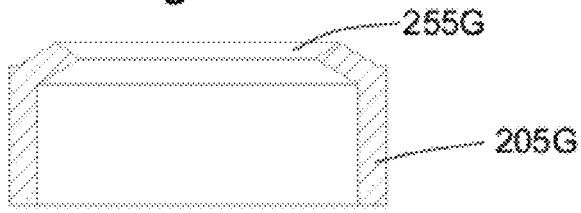
FIG. 7*c* is a cross-sectional diagram of an embodiment of a protective ring with a wiper.

FIG. 7*c* depicts a cross-sectional view of another embodiment of a protective ring 205G comprising a wiper 255G. The wiper 255G may comprise an elastic material. It is believed that the wiper 255G may further aid in preventing debris from penetrating between a shield and a shank.

Figure 7D:
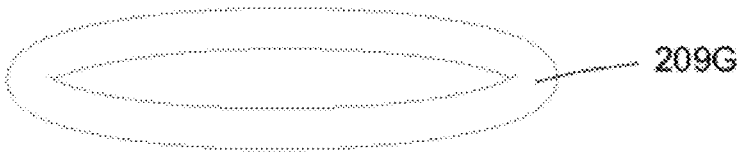
FIG. 7*d* is a perspective diagram of an embodiment of an O-ring.

FIG. 7*d* depicts an embodiment of an O-ring 209G. The O-ring 209G may comprise an elastic material.

Figure 7E:
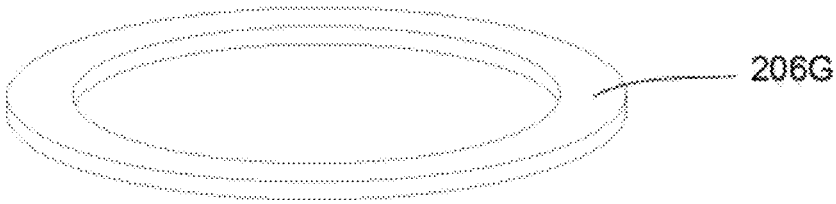
FIG. 7*e* is a perspective diagram of an embodiment of a rubber washer.

FIG. 7*e* depicts an embodiment of a rubber washer 206G. The rubber washer 206G may function as a seal and as a friction surface.

Whereas the present invention has been described in particular relation to the drawings attached hereto, it should be understood that other and further modifications apart from those shown or suggested herein, may be made within the scope and spirit of the present invention.

What is claimed is:

1. A degradation assembly comprising:

a shank adapted to be retained within a holder;

a rotary component having a distal end, a proximal end, and an impact tip bonded to the distal end, the proximal end having a recess adapted to receive the shank in a rotatable connection such that the rotary component is able to rotate relative to the shank;

a pressing seal element disposed between the rotary component and the shank; and a pressurized rigid element disposed adjacent to the seal element, wherein the pressing seal element presses the pressurized rigid element to form a slidable seal between the shank and the rotary component.

2. A degradation assembly comprising:

a shank comprising a first end and a second end, the second end adapted to be retained within a holder;

a shield having a recess adapted to rotatably connect to the first end of the shank;

an impact tip coupled to the shield and opposing the shank;

a pressing seal element disposed between the shield and the shank; and a pressurized rigid element disposed adjacent to the seal element, wherein the pressing seal element presses the rigid element to form a slidable seal between the shank and the shield.

3. The degradation assembly of claim 2, wherein the first end of the shank is received within the recess.

4. The degradation assembly of claim 2, wherein the pressurized rigid element has a concave surface facing the pressing seal element.

5. The degradation assembly of claim 2, wherein the pressurized rigid element has a convex surface opposing the pressing seal element.

6. The degradation assembly of claim 2, wherein the pressurized rigid element has a polished surface opposing the pressing seal element.

7. The degradation assembly of claim 2, wherein the pressurized rigid element has a textured surface facing the pressing seal element.

8. The degradation assembly of claim 2, wherein the pressurized rigid element has a wear resistant surface opposing the pressing seal element.

9. The degradation assembly of claim 8, wherein the wear resistant surface includes a material selected from the group consisting of diamond, cubic boron nitride, lonsdaleite, and tungsten carbide.

10. The degradation assembly of claim 2, wherein the pressing seal element comprises an elastic O-ring.

11. The degradation assembly of claim 2, wherein the pressing seal element comprises a compression spring disposed around the shank.

12. The degradation assembly of claim 2, wherein the pressing seal element has a textured outer surface.

13. The degradation assembly of claim 2, further comprising a protective ring disposed axially around the degradation assembly, adjacent to both the shield and the shank.

14. The degradation assembly of claim 13, wherein the protective ring comprises a wiper.

15. The degradation assembly of claim 2, further comprising a spring clip intermediate the shield and the shank.

16. The degradation assembly of claim 2, wherein the shank comprises a ledge retaining the pressing seal element.

17. The degradation assembly of claim 2, comprising a lubricant chamber disposed within the shank.

18. The degradation assembly of claim 17, wherein the pressing seal element pressing the rigid element retains lubricant within the lubricant chamber.

19. The degradation assembly of claim 2, wherein the assembly forms a pick.

* * * * *